US005395277A

United States Patent [19]

Gillis

[11] Patent Number: 5,395,277

[45] Date of Patent: Mar. 7, 1995

[54] VIEWING TOY

[76] Inventor: Robert E. Gillis, P.O. Box 67, Aptos, Calif. 95003

[21] Appl. No.: 968,523

[22] Filed: Oct. 28, 1992

[51] Int. Cl.[6] ..... A63H 1/00; A63H 1/06

[52] U.S. Cl. ..... 446/236; 446/246; 446/266

[58] Field of Search ..... 446/219, 236, 237, 243, 446/244, 246, 266, 491; 472/57, 61; 352/208, 57, 63; 356/25; 359/466, 227, 234, 236, 616

[56] References Cited

U.S. PATENT DOCUMENTS 2,887,928 5/1959 Misuraca .

FOREIGN PATENT DOCUMENTS 12797 11/1912 United Kingdom ..... 352/63

503036 3/1939 United Kingdom ..... 356/25

*Primary Examiner*—Robert A. Hafer

*Assistant Examiner*—Jeffrey D. Carlson

[57] ABSTRACT

A viewing toy is provided which may be held by a user in front of his eyes. The toy has a plurality of transparent openings and, when the toy is rotated by the user's finger, a pleasant visual effect is obtained when viewing a visual target.

1 Claim, 1 Drawing Sheet

VIEWING TOY

BRIEF SUMMARY OF THE INVENTION

This invention relates to toys in general and, in particular, to a viewing toy which may be held in front of the eyes of a user and rotated to create a pleasing visual effect when observing some visual target.

The prior art includes rather sophisticated stroboscopic devices as shown in the Misuraca U.S. Pat. No. 2,887,928 and in the Ashdown U.S. Pat. No. 1,746,179. These stroboscopic devices are typically used by mechanics and machinists to view rotating machinery for a variety of purposes. In contrast, the present invention relates to an extremely simple viewing toy which utilizes relatively large observation openings compared to typical stroboscopic viewing slits. The prior art also includes stereoscopic viewing apparatus wherein light from a visual target is alternately presented to one eye and then the other eye, as shown in Sullivan U.S. Pat. No. 1,189,308. The present invention utilizes a very simple mechanism which is not limited to presenting light from the visual target alternately to one eye and then the other eye.

The prior art also includes a relatively complex stroboscopic optical game device shown in Schneider U.S. Pat. No. 2,731,265 which uses relatively complex gearing to achieve a stroboscopic effect. The present invention is much simpler, does not require the use of gears and is actuated by the fingers of the user.

The primary object of the invention is to provide a simple viewing toy which may be held in front of the eyes of the user and rotated by the user's fingers to obtain a pleasing visual effect like old fashioned motion pictures when observing a selected moving visual target.

Other objects and advantages will become apparent from the following description of the preferred embodiment wherein:

DETAILED DESCRIPTION OF THE DRAWINGS

Figure 1:
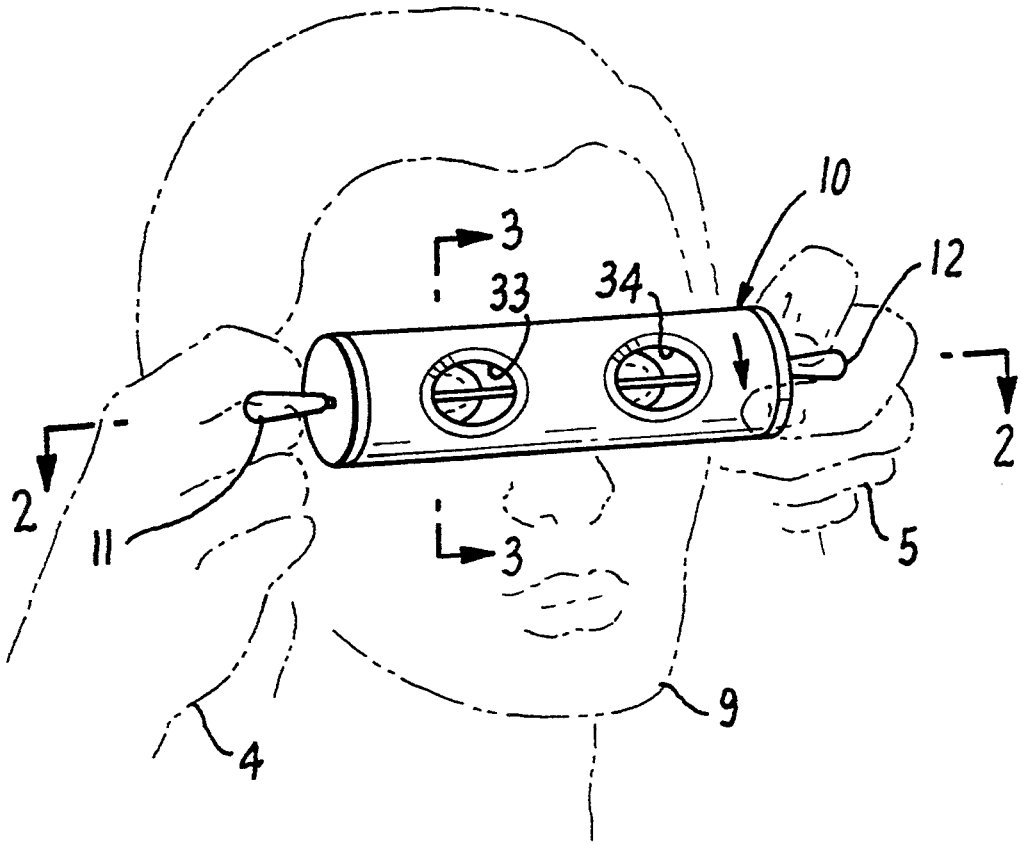
FIG. 1 is a perspective view of the viewing toy according to the present invention as held by a user in front of his eyes.

As shown in FIG. 1, a viewing toy shown generally as 10 is being held by a user 9 in front of his eyes 7 and 8.

The device has a pair of handles 11 and 12 which may be held by the hands 4 and 5, respectively, of user 9.

Handles 11 and 12 are carried at both ends of spindle 15. A hollow, opaque cylindrical drum 20 is carried by spindle 15 by the use of drum end pieces 21 and 22. Drum 20, together with end pieces 21 and 22, is adapted to rotate about a horizontal axis represented by spindle 15. Drum 20 may be easily rotated in either of two directions by the user's fingers.

A plurality of transparent openings 31,32,33 and 34 are formed in the surface of drum 20 so that, as the drum is rotated in front of a user's eyes, a pleasant visual effect is attained by the periodic eclipse causing by the opaque portion of drum 20 alternating with the periodic alignment of openings 31–34 with a visual target.

Figure 3:
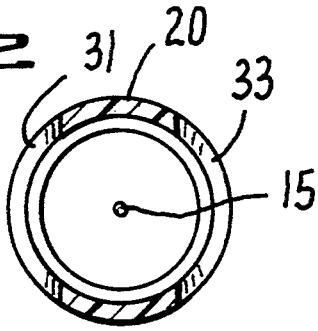
FIG. 3 is a section on the line 3—3 of FIG. 1.

As shown in FIG. 1, openings 33 and 34 are elliptical. As shown best in FIG. 3, elliptical openings 31 and 33 extend more than 90° around the circumference of drum 20. This particular arrangement provides an eclipse period which is shorter in duration than the viewing period for the size openings shown in FIGS. 1 and 3.

Figure 2:
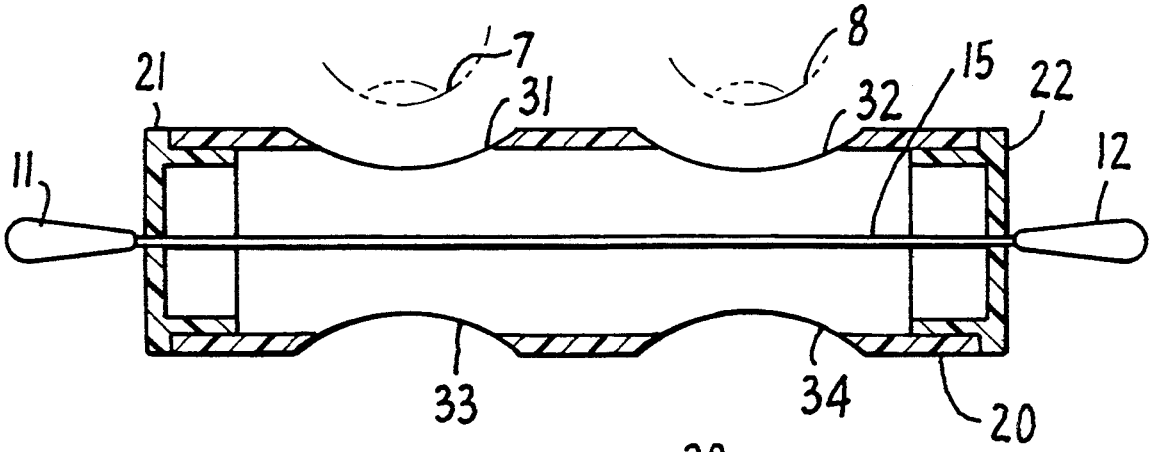
FIG. 2 is a section on the line 2—2 of FIG. 1.

As shown best in FIG. 2, openings 31 and 32 are spaced apart a distance equal to the distance between the user's eyes 7 and 8 and the other two openings 33 and 34 are located on the opposite side of drum 20, whereby the user can hold the device stationary in front of his eyes as shown in FIG. 1 and look directly through the device at a visual target.

I claim:

1. A viewing toy which may be held by a user in front of his eyes, through which the user may observe a selected visual target, comprising a handle, a spindle which carries said handle, a hollow, opaque drum carried by said spindle, said drum being adapted to rotate about a horizontal axis, and four openings formed in the surface of said drum, wherein two of said openings are spaced apart a distance equal to the distance between a user's eyes, and the other two openings are located on the opposite side of said drum, and when said toy is held in front of the user's eyes and said drum is rotated, the user experiences two viewing periods and two eclipse periods for each complete rotation of said drum, each viewing period occurring as the openings are aligned with the user's eyes, and each eclipse period occurring as the opaque portion of said drum passes in front of the user's eyes, wherein each of said openings extends more than 90° around the circumference of said drum, so that as the drum is rotated in front of a user's eyes, each eclipse period is shorter in duration than the viewing period, and a pleasant visual effect is attained.

* * * * *